US006382776B1

(12) United States Patent
Lee et al.

(10) Patent No.: US 6,382,776 B1
(45) Date of Patent: May 7, 2002

(54) BUBBLE-JET TYPE INK-JET PRINTING HEAD

(75) Inventors: Chung-jeon Lee, Seoul; Jae-ho Moon, Suwon, both of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/818,668

(22) Filed: Mar. 28, 2001

(30) Foreign Application Priority Data

Sep. 30, 2000 (KR) ..... 00-57627

(51) Int. Cl.[7] ..... B41J 2/05
(52) U.S. Cl. ..... 347/62
(58) Field of Search ..... 347/56, 62, 65, 347/57, 58, 59, 60, 61, 63, 64, 66, 67

(56) References Cited

U.S. PATENT DOCUMENTS 4,914,562 A * 4/1990 Abe et al. ..... 347/63
5,635,968 A * 6/1997 Bhaskar et al. ..... 347/59

* cited by examiner

*Primary Examiner*—John Barlow
*Assistant Examiner*—Julian D. Huffman
(74) *Attorney, Agent, or Firm*—Robert E. Bushnell, Esq.

(57) ABSTRACT

A bubble-jet type ink-jet printing head is provided. The ink-jet printing head includes a nozzle plate in which a plurality of nozzles, through which ink is ejected, are formed, a substrate for supporting the nozzle plate, on which a plurality of heaters having three-dimensionally concave surfaces oppose the plurality of nozzles, respectively, electrodes which are formed on the top surface of the substrate and electrically coupled to each heater so as to apply current to the heater, a plurality of ink chambers which are formed between the bottom of the nozzle plate and the surfaces of the corresponding heaters and filled with ink, and an ink feed channel, formed between the nozzle plate and the substrate so as to connect with the ink chambers, for supplying ink to the ink chambers. Each heater includes a hemispherical member and a flange disposed along the rim of the hemispherical member. The ink feed channel connects with the entire circumference of each ink chamber. Accordingly, expansion energy of a bubble formed on the surface of the heater is concentrated toward the nozzle thereby improving a energy efficiency, and a back flow of ink is prevented by the bubble formed on the flange of the heater. Furthermore, ink can quickly refills the ink chamber after ejection of an ink droplet, thereby further increasing the ejection driving frequency.

21 Claims, 10 Drawing Sheets

BUBBLE-JET TYPE INK-JET PRINTING HEAD

CLAIM OF PRIORITY

This application makes reference to, incorporates the same herein, and claims all benefits accruing under 35 U.S.C. §119 from my application entitled BUBBLE-JET TYPE INK-JET PRINTING HEAD filed with the Korean Industrial Property Office on Sep. 30, 2000 and there duly assigned Ser. No. 2000/57627.

BACKGROUND OF THE INVENTION

1. Field of the Invention

The present invention relates to an ink-jet printing head, and more particularly, to a bubble-jet type ink-jet printing head having a concavely hemispherical heater.

2. Description of the Related Art

Ink-jet printing heads are devices for printing a predetermined color image by ejecting a small volume of printing ink on a desired position on a recording sheet. The ink ejection mechanism of an ink-jet printer is largely categorized into two types: an electrothermal transducer type (or bubble-jet type) in which a heat source is employed to form a bubble in ink causing ink droplets to be ejected, and an electromechanical transducer type in which a piezoelectric bends to change the volume of ink causing ink droplets to be expelled.

According to the bubble-jet type ink ejection mechanism, if power is applied to a heater consisting of resistive heating elements, ink which is in contact with the surface of the heater is rapidly heated to a high temperature of 400° C. forming a bubble on the surface of the heater. The produced bubble expands to impose pressure on an ink chamber filled with ink, which cause drops of ink near a nozzle to be ejected from the ink chamber through the nozzle.

An ideal ink jet printhead is 1) easy to manufacture, 2) produces high quality color images, 3) is void of crosstalk and backflow between nozzles, and 4) is capable of high speed printing. What is needed is a design for an ink jet printhead that achieves these goals.

SUMMARY OF THE INVENTION

It is therefore an object of the present invention to provide an improved ink jet printhead design.

It is also an object of the present invention to provide an improved heater design in a bubble jet ink jet printhead.

It is still an object of the present invention to provide a bubble-jet type ink jet printing head having a concavely hemispherical heater, which is capable of effectively utilizing energy supplied to the heater for bubble formation.

It is further an object to provide an ink jet printhead that can resupply ink to the ink chamber from all 360 degrees directions.

It is yet an object of the present invention to provide a heater with a flange having a high resistance to produce a bubble first about the flange portion to prevent backflow and crosstalk between nozzles.

Accordingly, to achieve the above objectives, the present invention provides a bubble-jet type ink-jet printing head including a nozzle plate in which a plurality of nozzles, through which ink is ejected, are formed, a substrate for supporting the nozzle plate, on which a plurality of heaters having three-dimensionally concave surfaces oppose the plurality of nozzles, respectively, electrodes which are formed on the top surface of the substrate and electrically coupled to each heater so as to apply current to the heater, a plurality of ink chambers which are formed between the bottom of the nozzle plate and the surfaces of the corresponding heaters and filled with ink, and an ink feed channel, formed between the nozzle plate and the substrate so as to connect with the ink chambers, for supplying ink to the ink chambers. Preferably, the heat generated per unit area is substantially uniform over the entire concave surface of each heater. This allows the bubble to be uniformly formed and developed over the entire concave surface of the heater.

Each heater is substantially hemispherical. The shape of the heater concentrates expansion energy of a bubble formed on the surface of the heater toward the nozzle, thereby improving the energy efficiency. Furthermore, each heater includes a hemispherical member and a flange disposed along the rim of the hemispherical member. This feature of the heater not only improves the energy efficiency as described above but also prevents a back flow of ink by bubbles formed on the flange. Preferably, the ink feed channel connects with the entire circumference of each ink chamber. Thus, ink can quickly refill the ink chamber after the ejection of an ink droplet, thus increasing the ejection driving frequency. Ink feed channel may be formed on the bottom surface of the nozzle plate or on the top surface of the substrate to a predetermined depth.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1A:
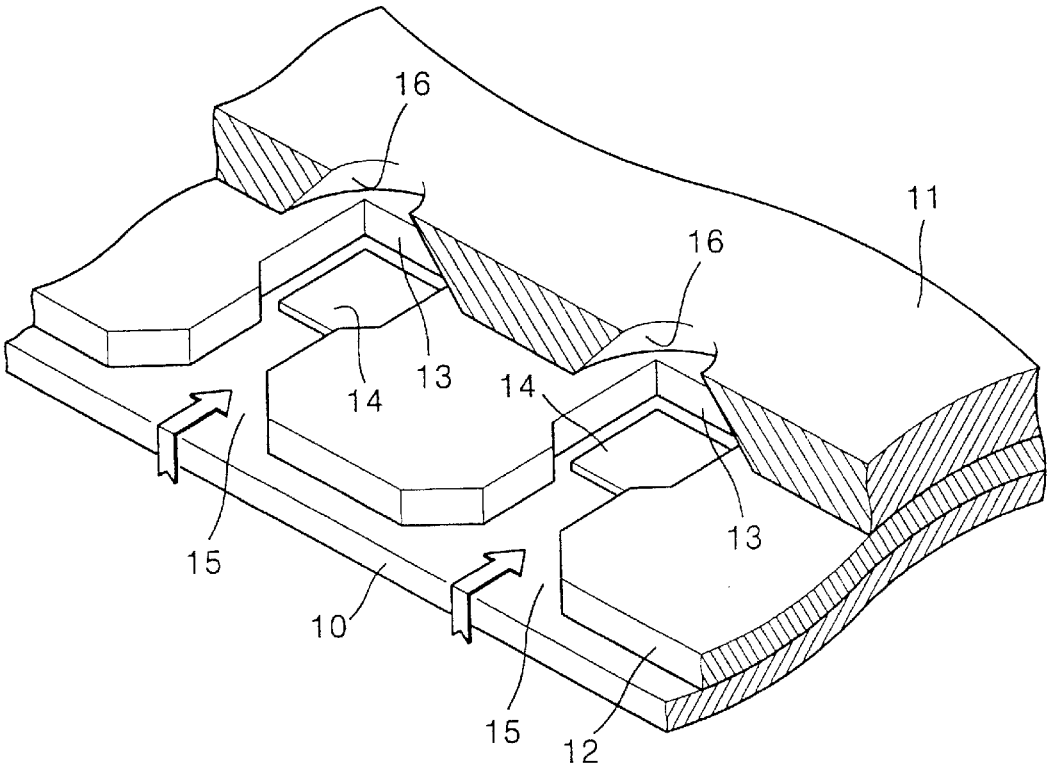
FIG. 1A (PRIOR ART)
FIGS. 1A and 1B are an exploded perspective view showing an example of the structure of a conventional bubble-jet type ink-jet printing head and a cross-sectional view for explaining a process of ejecting an ink droplet, respectively.
Figure 1B:
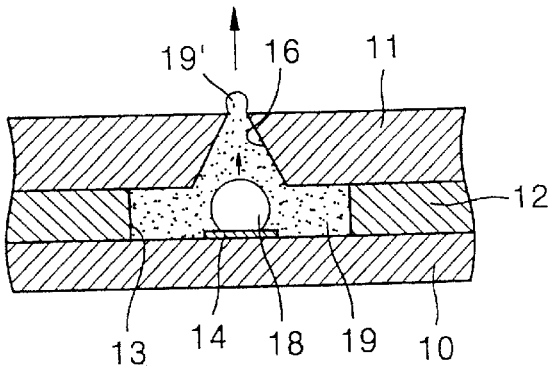
FIG. 1B (PRIOR ART)

FIG. 1A is an exploded perspective view showing an example of the structure of a conventional bubble-jet type ink-jet printing head disclosed in U.S. Pat. No. 4,882,595, and FIG. 1B is a cross-sectional view for explaining a process of ejecting ink droplets of the printing head shown in FIG. 1A. The conventional bubble-jet type ink-jet printing head shown in FIGS. 1A and 1B includes a substrate 10, barrier walls 12 disposed on the substrate 10 for forming an ink chamber 13 filled with ink 19, a heater 14 disposed in each ink chamber 13, and a nozzle plate 11 in which nozzles 16 for ejecting an ink droplet 19' are formed. The ink 19 is introduced into the ink chamber 13 through an ink feed channel 15, and furthermore the ink 19 is filled within the nozzles 16 connecting with the ink chamber 13 by capillary action. In the thus-configured printing head, if current is supplied to the heater 14, the heater 14 heats the ink 19 present in the ink chamber 13 to form a bubble 18. The bubble 18 continues to expand to exert pressure on the ink 19 present in the ink chamber 13, which causes the ink droplet 19' to be expelled through the nozzle 16. Then, the ink 19 is introduced through the ink feed channel 15 and refills the ink chamber 13.

However, the conventional ink-jet printing head has some drawbacks. First, since the heater is flat and thus the area in contact with ink is relatively small, a small amount of bubbles are generated. The pressure imposed on an ink chamber due to expansion of the bubble rises at low speed, which results in a low ink ejection driving frequency and reduced ink ejection energy due to dispersion of expansion energy of the bubble. This decreases the print speed while increasing the unnecessary power consumption. Second, since the ink feed channel is disposed only on one side of the ink chamber, a time taken to refill ink into the ink chamber is long, which decreases the print speed. Third, since a separate device for preventing a back flow of ink is not provided, a back flow star of ink through an ink feed channel may occur in the opposite direction to the nozzle during ejection of ink droplets due to the pressure rise in the ink chamber. This results in a reduced ejection energy and the occurrences of interference between adjacent nozzles, thereby degrading print image quality.

Figure 2:
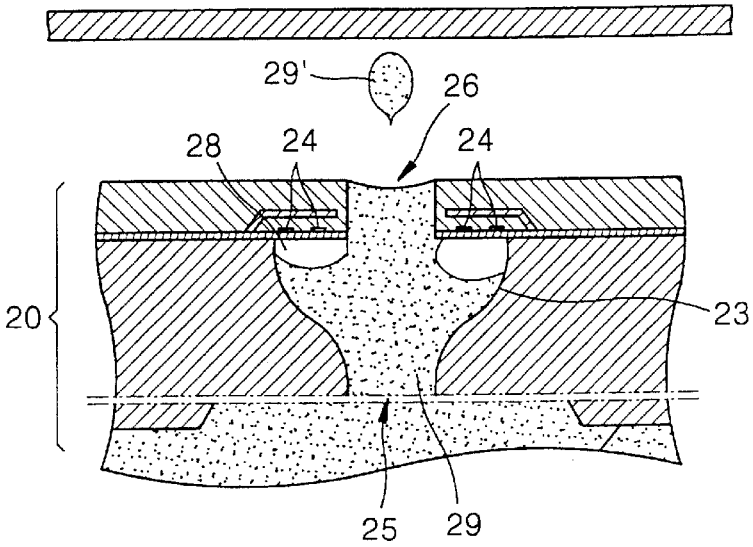
FIG. 2 (PRIOR ART)
FIG. 2 is a cross-sectional view of an ink ejector, which shows another example of a conventional bubble-jet type ink-jet printing head.

FIG. 2 is a cross-sectional view of an ink ejector which shows another example of the structure of a conventional bubble-jet type ink-jet printing head disclosed in U.S. Pat. No. 6,019,457. Referring to FIG. 2, at an upper end of an ink chamber 23 penetrating a substrate 20 is formed a nozzle 26, while at the lower end thereof is formed an ink inlet 25. Heaters 24 arranged in various forms surrounding the nozzle 26 heats ink 29 filled within the ink chamber 23 to form a bubble 28. The bubble 28 continues to expand, which exerts pressure on the ink 29 present in the ink chamber 23, thereby causing an ink droplet 29 to be ejected through the nozzle 26. The ink 29 is then introduced through the ink inlet 25 and refills the ink chamber 23.

The thus-configured conventional ink-jet printing head also suffers from drawbacks similar to the ink-jet printing head of FIGS. 1A and 1B previously mentioned. That is, due to the shape of the ink chamber, expansion energy of the bubble is dispersed up and down, and a separate device for preventing a back flow of ink is not provided. In addition, since the heaters are disposed adjacent to the nozzle and hence the nozzle is easily overheated, ink may be scorched on the surface of the nozzle to clog the nozzle, which fails to eject ink droplets.

Figure 3A:
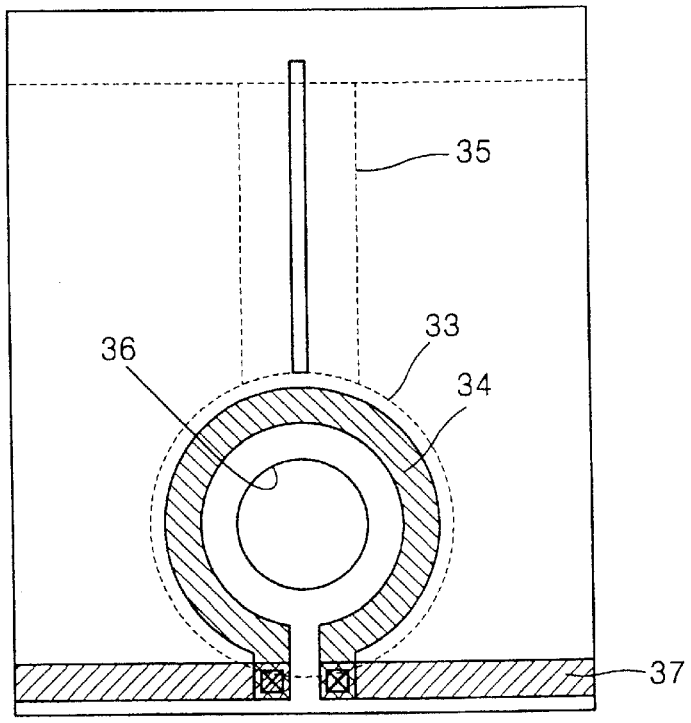
FIGS. 3A and 3B are a top view of one of ink-jet printing heads disclosed in the Korean Patent Application No. 10-2000-0022260 and a cross-sectional view for explaining a process of ejecting an ink droplet, respectively.
Figure 3B:
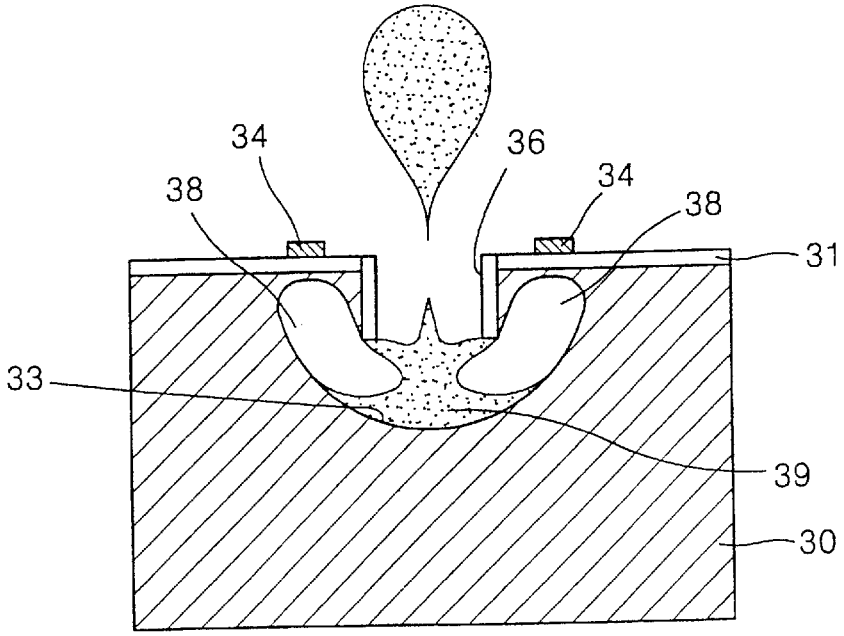

To overcome the above drawbacks, the applicant of the present invention has proposed an ink-jet printing head having an improved structure through the Korean Patent Application No. 10-2000-0022260 filed Apr. 26, 2000. FIG. 3A is a top view of one example of ink-jet printing heads disclosed in the Korean Patent Application No. 10-2000-0022260, and FIG. 3B is a cross-sectional view for explaining a process of ejecting ink droplets. Referring to FIGS. 3A and 3B, a substantially a hemispherical ink chamber 33 filled with ink 39 is formed on the surface of a substrate 30 obtained from a silicon wafer. A nozzle 36 (or orifice) corresponding to the ink chamber 33 is formed on the substrate 30, and a nozzle plate 31 on which an annular or omega- shaped heater 34 are disposed above the ink chamber 33 and surrounding the nozzle 36. Here, both ends of the heater 34 are coupled to the electrodes 37 for supplying current formed on the nozzle plate 31. An ink channel 35 connecting to the ink chamber 33 is formed on the substrate 30 underlying the nozzle plate 31. The thus-configured ink-jet printing head produces a doughnut-shaped bubble 38 by the annular or omega-shaped heater 34.

The doughnut-shaped bubble 38 prevents a back flow of the ink 39 and therefore avoids interference between adjacent nozzles. Furthermore, a barrier wall (not shown) formed at a connecting portion of the ink chamber 33 and the ink channel 35 is also provided for preventing a back flow of the ink 39. Furthermore, since the heater 34 is annular or omega-shaped, it is rapidly heated or cooled due to the wide area. Thus, a time taken from formation of the bubble 38 to the disappearance is shortened, thereby providing a high ejection driving frequency.

However, the ink-jet printing head having the annular or omega-shaped heater has a problem with low power consumption efficiency since the heater is flat and is not in direct contact with ink. Furthermore, the ink channel is disposed only one side of the ink chamber, which decreases the print speed.

Figure 4A:
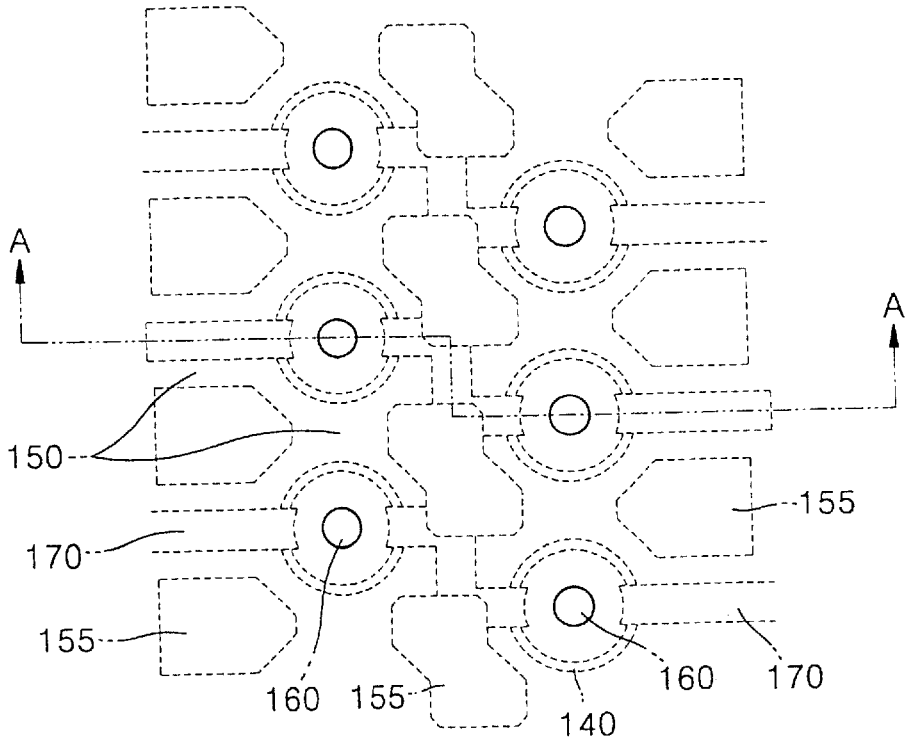
FIGS. 4A and 4B are a top view of an ink-jet printing head according to a preferred embodiment of the present invention and a cross-sectional view of the ink-jet printing head of FIG. 4A taken along line A—A, respectively.
Figure 4B:
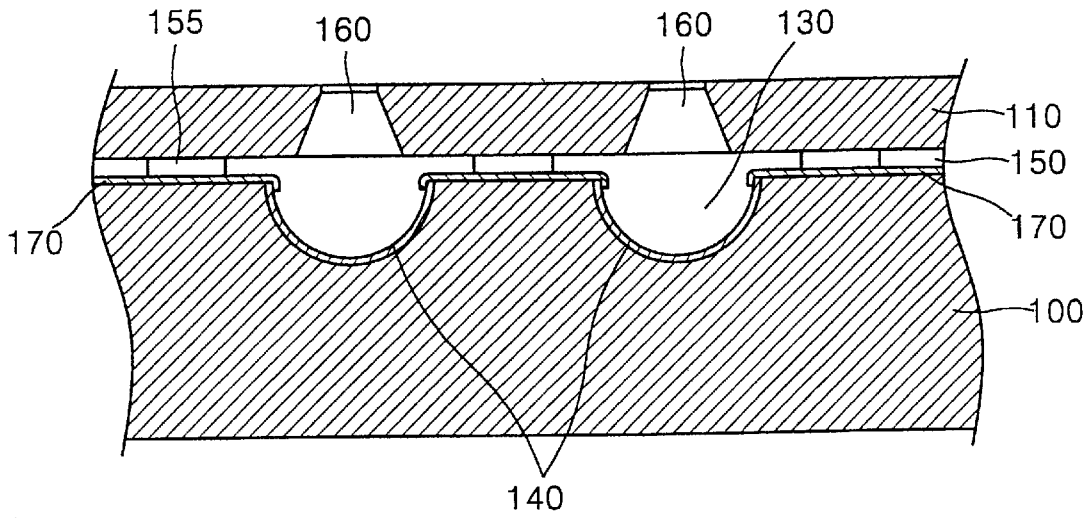

Referring to FIGS. 4A and 4B, a bubble-jet type ink-jet printing head according to a preferred embodiment of the present invention includes a nozzle plate 110 in which a plurality of nozzles 160 are formed, and a substrate 100 for supporting the nozzle plate 110. Ink ejection is made through the nozzles 160 as described below. A heater 140 corresponding to each of the plurality of nozzles 160 is formed on the substrate 100. The heater 140 has a three-dimensionally concave surface opposing the nozzles 160. The heater 140 is preferably substantially hemispherical.

Electrodes 170 electrically coupled to the heater 140 for applying current to the heater 140 are formed on the substrate 100. A space formed between the bottom of the nozzle plate 110 and the surface of the heater 140 is an ink chamber 130 filled with ink. Thus, the ink is in direct contact with the surface of the heater 140.

An ink feed channel 150 for introducing ink into the ink chamber 130 is formed between the nozzle plate 110 and the substrate 100. The height of the ink feed channel 150 is maintained by spacers 155 disposed between the nozzle plate 110 and the substrate 100. The ink feed channel 150 may be formed either on the bottom surface of the nozzle plate 110 or on the top surface of the substrate 100 to a predetermined depth as described later. Furthermore, the ink feed channel 150 is formed in such a way as to connect with the entire circumference of the ink chamber 130. This enables the ink to promptly refill the ink chamber 130 after having ejected ink droplets. The spacers 155 are the remaining portions of the bottom surface of the nozzle plate 110 or the top surface of the substrate 100, at which the ink feed channel is not formed. The ink feed channel 150 and the spacers 155 may be arranged in various forms, and FIG. 4A shows an example thereof.

Meanwhile, a manifold (not shown) for supplying ink from an ink reservoir to the ink feed channel 150 is formed at a predetermined region on the substrate 100. The manifold connects with the ink reservoir. A via hole may be provided in the manifold for connecting with the ink reservoir. Depending on the shape and location of the ink reservoir both manifold and via hole or either of them may be provided.

Figure 5:
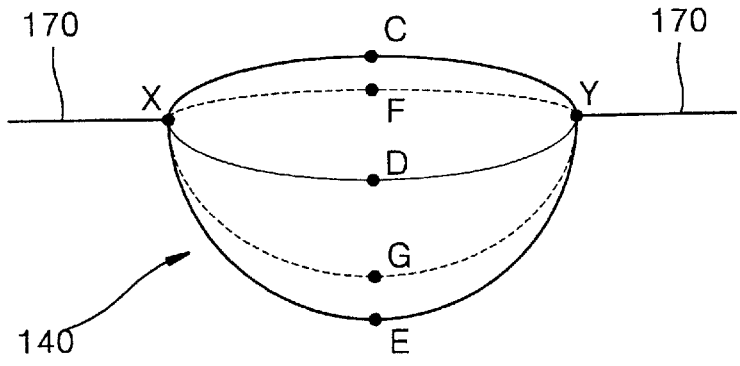
FIG. 5 shows a path of current flowing through a heater by a voltage applied to both electrodes of the heater of the ink-jet printing head of FIGS. 4A and 4B.

FIG. 5 shows a path of current flowing through the heater by a voltage applied to both ends thereof Referring to FIG. 5, the hemispherical heater 140 described above has points X and Y ail coupled to the electrodes 170, both points being symmetrical with respect to the center. If a voltage is applied to both electrodes 170, current flows through the heater 140. In this case, the current flows along paths X-C-Y and X-D-Y formed on the rim of the heater 140, path X-E-Y formed on the bottom thereof, and paths X-F-Y and X-G-Y formed on the surface of arbitrary middle portions thereof. Since the heater 140 is hemispherically-shaped, the paths all have the same distance. Thus, current flows uniformly over the entire surface of the heater 140 and therefore the amount of heat generated is uniform over the entire surface. This enables a bubble to be uniformly formed and grown over the entire surface of the heater 140.

A process of ejecting an ink droplet in the thus-configured ink-jet printing head according to the preferred embodiment of the present invention will now be described with reference to FIGS. 6A–6D. First, referring to FIG. 6A, ink 190 is supplied through the ink feed channel 150 into the space formed between the bottom of the nozzle plate 110 and the surface of the heater 140, that is, ink chamber 130. If the ink chamber 130 is filled with the ink 190, current is supplied to the heater 140 through the electrodes 170.

If the current is supplied to the heater 140, the ink 190 in contact with the surface of the heater 140 is rapidly heated to 400° C. to form bubbles 180. In this case, since the heater 140 has a three-dimensionally concave surface, the area of a portion where the bubble 180 is formed is significantly wide compared to conventional heaters, thereby increasing the generation amount of initial bubbles 180. Furthermore, as described above, the bubbles 180 are formed uniformly over the entire surface of the heater 140. Since the ink 190 is in a direct contact with the surface of the heater 140, heat energy generated from the heater 140 is carried faster to the ink 190 thereby significantly increasing the speed at which the bubbles 180 are formed.

Figure 6A:
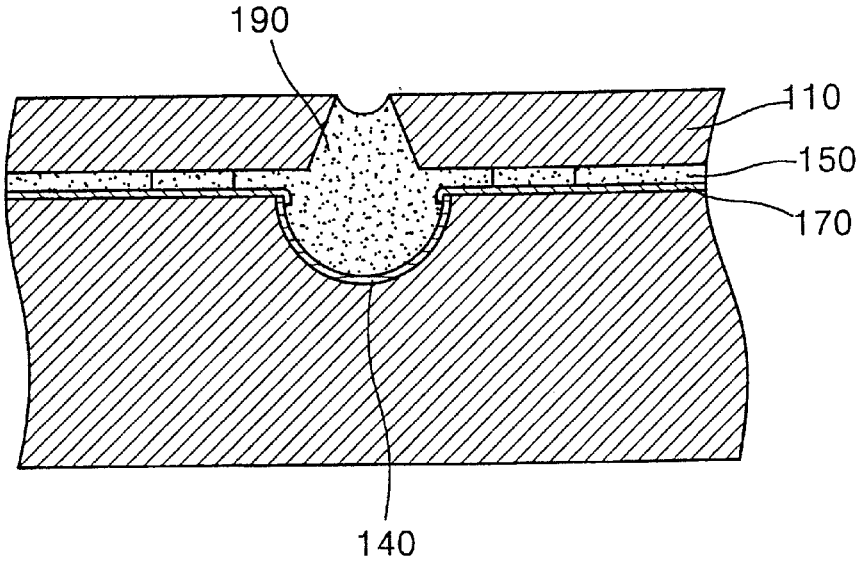
FIGS. 6A–6D are cross-sectional views for explaining a process of ejecting an ink droplet in the ink-jet printing head of FIGS. 4A and 4B.
Figure 6B:
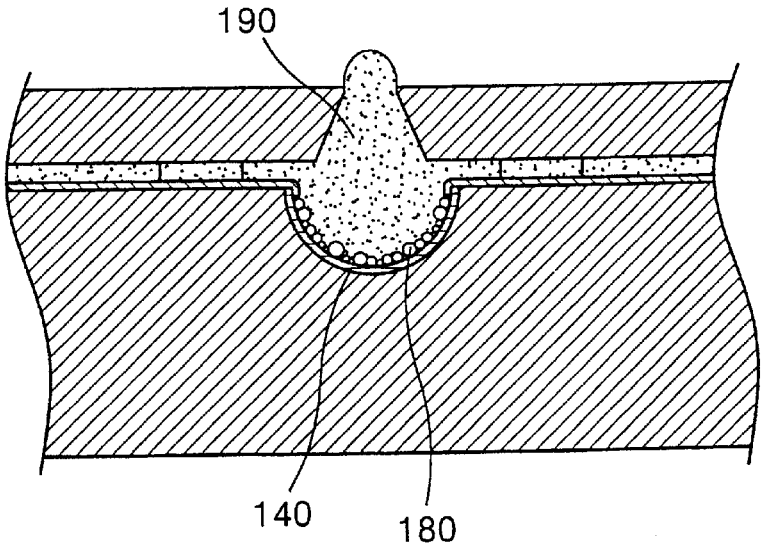
Figure 6C:
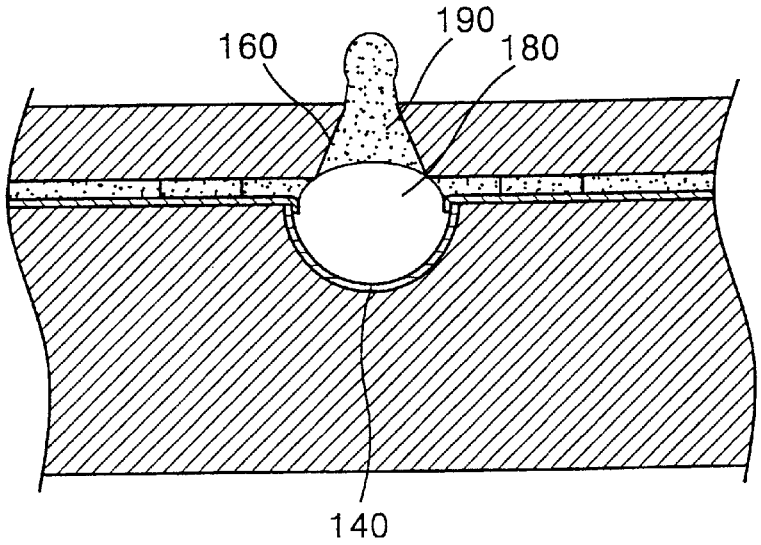

As described above, the thus-formed bubble 180 continuous to grow as shown in FIG. 6C, and due to the expansion of the bubble 180, pressure is imposed on the inside of the ink chamber 130 filled with the ink 190. In this case, since the heater 140 that opposes the nozzle 160 is concavely hemispherical, expansion energy of the bubble 180 is not scattered but concentrated toward the nozzle 160, thereby decreasing unnecessary energy consumption and accelerating the pressure rise in the ink chamber 130.

Figure 6D:
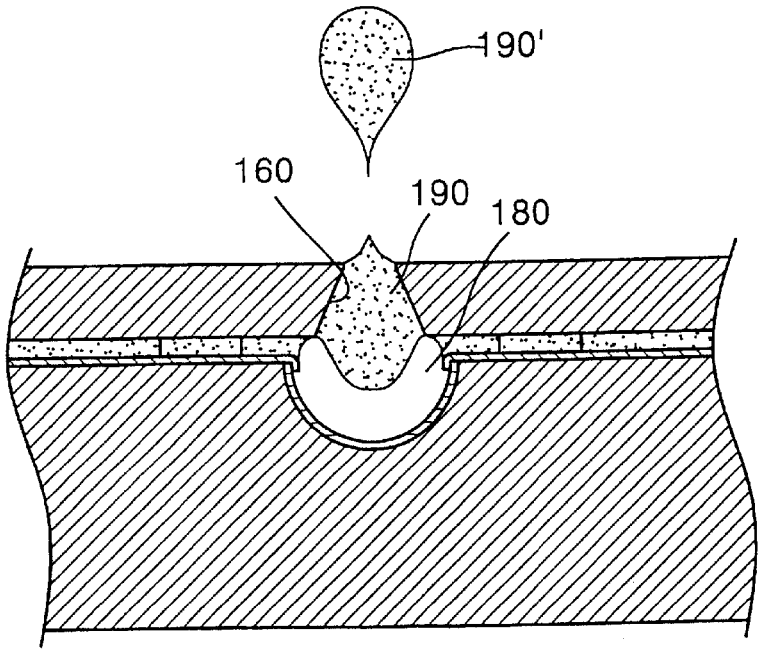

When the bubble 180 continues to expand so that the pressure in the ink chamber 130 exceeds a predetermined level, as shown in FIG. 6D, an ink droplet 190' is ejected through the nozzle 160 and then the bubble 180 starts to shrink. Following the ejection of the ink droplet 190', the ink 190 refills the ink chamber 130 through the ink feed channel 150. In this case, as described above, since the ink feed channel 150 connects with the entire circumference of the ink chamber 130, the ink 190 can promptly refill the ink chamber 130.

As described above, according to the preferred embodiment of the present invention, the heater 140 is concavely hemispherical, and the ink feed channel 150 connects with the entire all circumference of the ink chamber 130. Due to these features, energy efficiency and print speed are improved.

Figure 7:
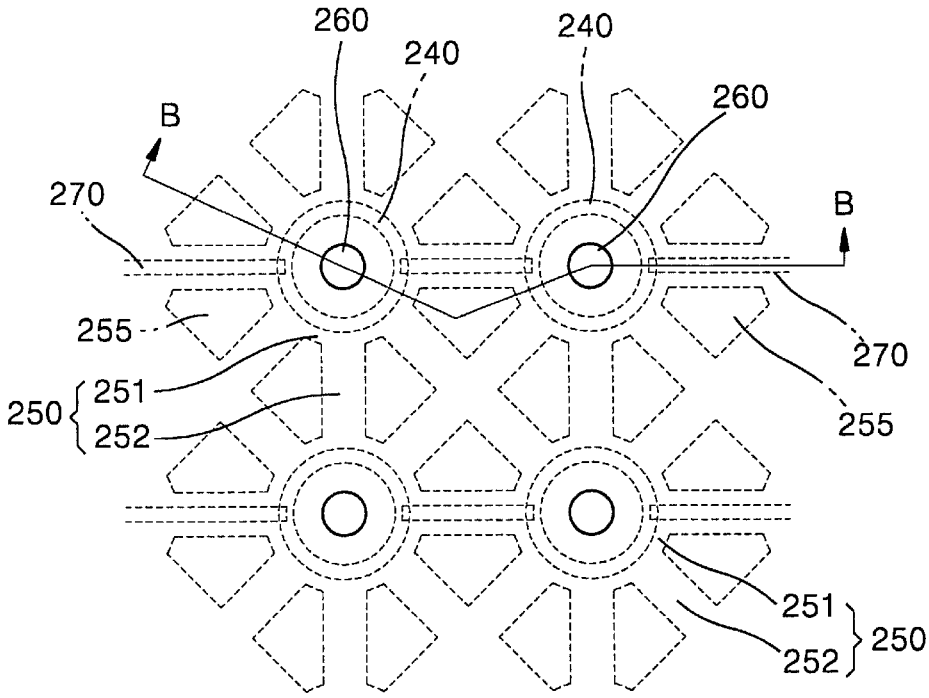
FIG. 7 is a top view of an ink-jet printing head according to another preferred embodiment of the present invention.
Figure 8:
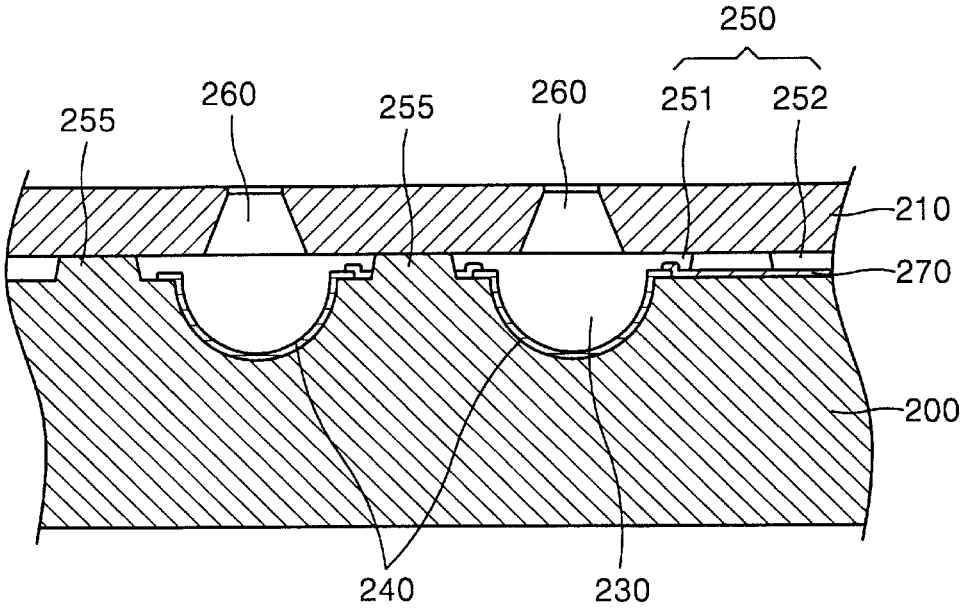
FIG. 8 is a cross-sectional view of the ink-jet printing head of FIG. 7 taken along line B—B, in which the ink feed channel is formed on the substrate.

FIG. 7 is a top view of an ink-jet printing head according to another embodiment of the present invention, and FIG. 8 is a cross-sectional view of the ink-jet print head taken along line B—B of FIG. 7, in which the ink feed channel is formed on the top surface of the substrate. Referring to FIGS. 7 and 8, like the preferred embodiment of the present invention described above, the bubble; jet type ink-jet printing head according to this embodiment includes a nozzle plate 210, in which a plurality of nozzles 260 are formed, and a substrate 200 that supports the nozzle plate 210. A heater 240 corresponding to each of the plurality of nozzles 260 is disposed on the top surface of the substrate 210. The heater 240 has a three-dimensionally concave surface that opposes the nozzle 260. Electrodes 270 for applying current to the heater 240, an ink chamber 230 formed between the bottom of the nozzle plate 210 and the surface of the heater 240, an ink feed channel 250 and spacers 255 formed between the nozzle plate 210 and the substrate 200 are the same as those in the embodiment previously mentioned, and thus a detailed explanation is omitted. The ink feed channel 250 and the spacers 255 may be arranged in various forms, and FIG. 7 shows an example in which both are arranged in a different form from FIG. 4A. In FIG. 7, ink feed channel 250 includes both annular channels or first passage 251 and radial channels or second passage 252, either etched into the substrate 200 or formed on a bottom side of the nozzle plate 210 and disposed between spacers 255 and formed exterior to heaters 240.

Figure 10:
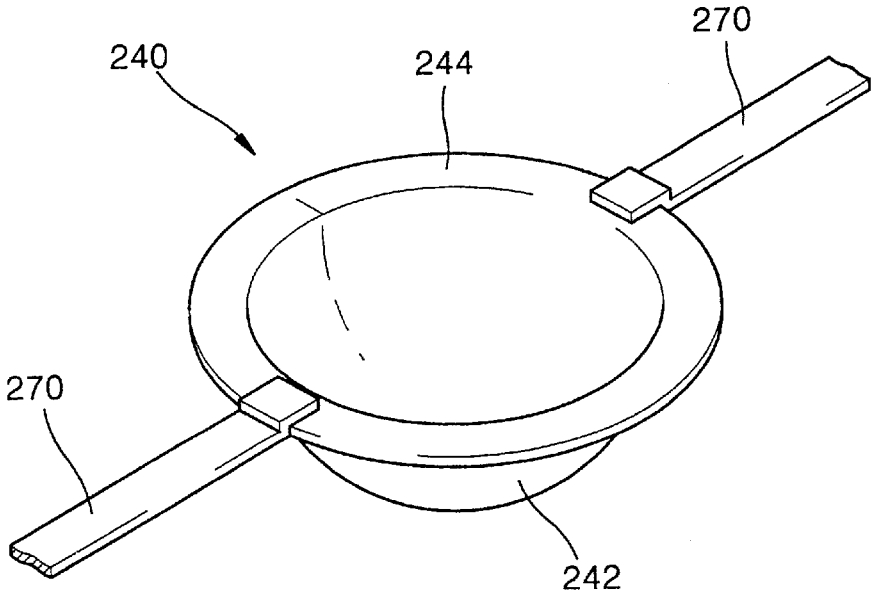
FIG. 10 is a perspective view of the heater shown in FIGS. 8 and 9.

The shape of the heater 240 will now be described in detail with reference to FIG. 10. The heater 240 includes a hemispherical member 242 and a flange 244 provided along the rim of the hemispherical member 242. The flange 244 is coupled to the electrodes 270 at its positions that oppose each other with respect to the center point. Since the flange 244 is provided in the heater 240 in this way, a back flow of ink is prevented by bubbles generated on the flange 244. To prevent the back flow of the ink, it is more effective to produce the bubbles on the flange 244 sooner than on the hemispherical member 242. Thus, the flange 244 has resistance higher than the hemispherical member 242 so that heat is generated in the flange 244 earlier than the hemispherical member 242. For this purpose, the thickness of the flange 244 may be made smaller than that of the hemispherical member 242 or the former may be formed of a material having higher resistance than the latter.

Turning to FIG. 8, the ink feed channel 250 is formed on the top surface of the substrate 200 to a predetermined depth. To this end, a first passage 251 is formed on the substrate 200 along the circumference of the heater 240 with an annular groove shape, and second passages 252 extend from the first passage 251 in the form of radial grooves. The second passages 252 connect with the manifold as described above. Since the ink feed channel 250 is formed in the form of the groove having a predetermined depth on the top surface of the substrate 200, the spacers 255 are formed so as to project toward the nozzle plate 210 from the substrate 200. The ink feed channel 250 may be formed in various ways, but preferably it is formed by etching and thin film formation processes performed on the top surface of the substrate 200.

Figure 9:
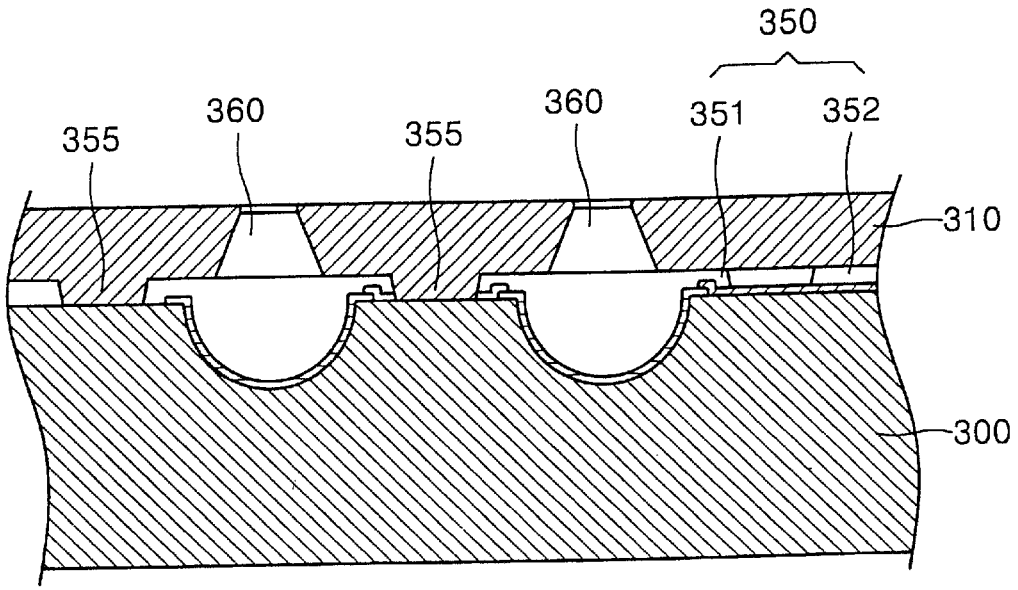
FIG. 9 is a cross-sectional view of an ink-jet printing head in which an ink feed channel is formed on the bottom surface of a nozzle plate.

FIG. 9 is a cross-sectional view of an ink-jet printing head in which an ink feed channel is formed on the bottom of a nozzle plate unlike in FIG. 8. An ink feed channel 350 shown in FIG. 9 is formed on the bottom of a nozzle plate 310 to a predetermined depth. For this purpose, a first passage 351 is formed on a substrate 300 along the circumference of a nozzle 360 in the form of an annular groove, and a second passages 352 extend from the first passage 351 in the form of radial grooves. The second passages 352 connect with the manifold as described above. Since the ink feed channel 350 is formed in the form of the groove having a predetermined depth on the bottom of the nozzle plate 310, spacers 355 are formed so as to project toward the substrate 300 from the nozzle plate 310. The ink feed channel 350 may be formed in various ways, but preferably it is formed by excimer laser machining performed on the bottom surface of the nozzle plate 310.

A process of ejecting an ink droplet in the ink-jet printing head according to the other embodiment of the present invention shown in FIGS. 7 and 8 will now be described with reference to FIGS. 11A–11D. First, referring to FIG. 11A, ink 290 is supplied through the ink feed channel 250 into a space formed between the bottom of the nozzle plate 210 and the surface of the heater 240, that is, the ink chamber 230. When the ink chamber 230 is filled with the ink 290, current is supplied to the heater 240 through the electrodes 270. When the current is supplied to the heater 240, as described above, bubbles 281 are initially formed on the surface of the flange 244 of the heater 240 having higher resistance. The bubbles 281 formed on the flange 244 forms a barrier between the ink chamber 230 and the ink feed channel 250, thereby preventing a back flow of the ink 290 in the ink chamber 290.

Figure 11A:
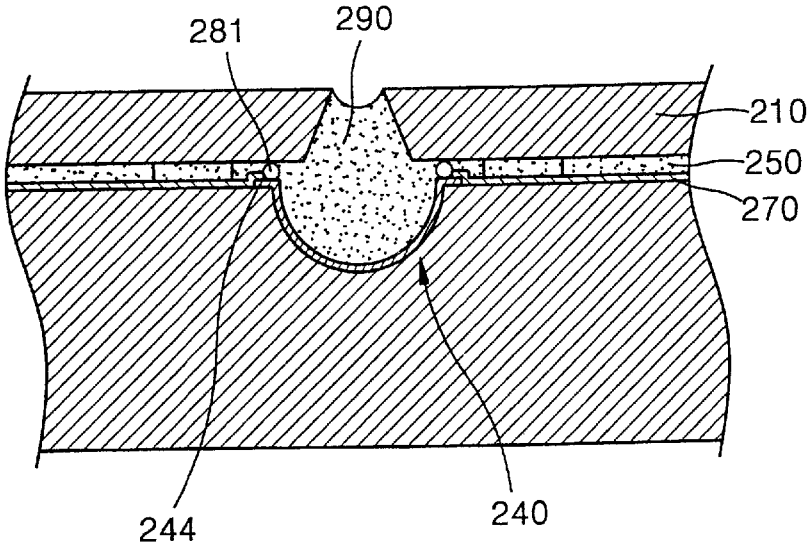
FIGS. 11A–11D are cross-sectional views for explaining a process of ejecting an ink droplet in the ink-jet printing head of FIGS. 8 and 9.
Figure 11B:
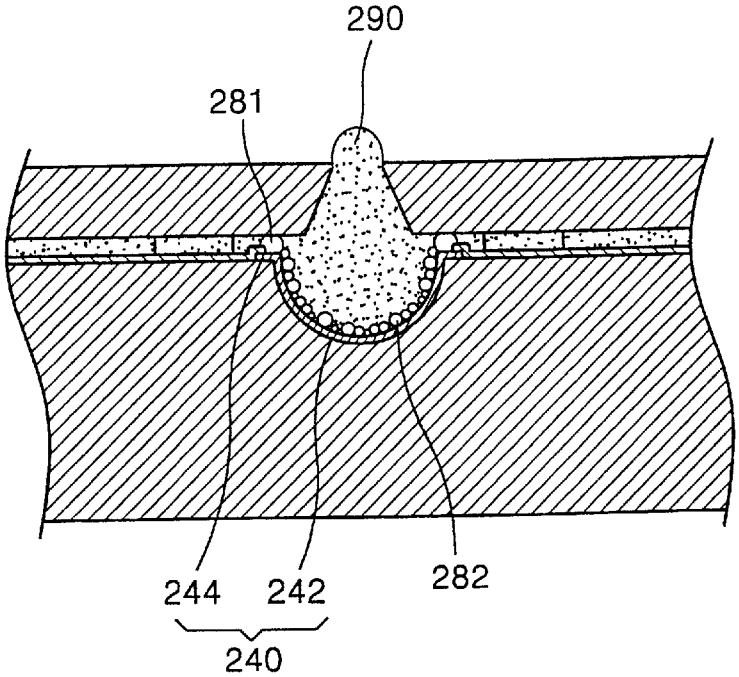

Next, as shown in FIG. 11B, bubbles 282 are formed on the surface of the hemispherical member 242 of the heater 240. In this case, since the heater 240 has a three-dimensionally concave surface, an area where the bubbles 282 are formed is significantly wide compared to conventional heaters, thereby increasing the generation amount of the bubbles 282. Furthermore, as described above, the bubbles 282 are formed uniformly over the entire surface of the hemispherical member 242 of the heater 240, while the bubbles 281 on the surface of the flange 244 are developed to form a securer barrier. Since the ink 290 is in direct contact with the surface of the heater 240, heat energy generated from the heater 240 is transferred faster to accelerate the speed at which the bubbles 281 and 282 are formed and developed.

Figure 11C:
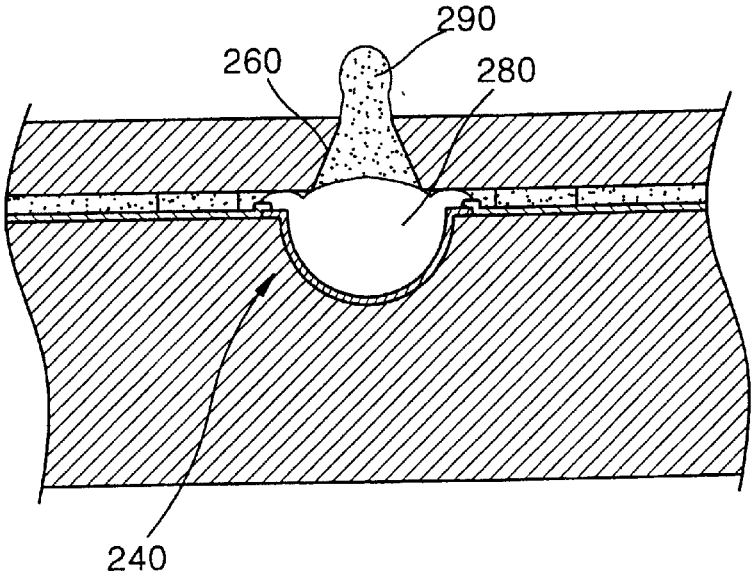

If the bubbles 281 and 282 formed on the surfaces of the flange 244 and the hemispherical member 242, respectively, continue to develop, as shown in FIG. 11C, they coalesce to form a larger bubble 280, which exerts pressure on the inside of the ink chamber 230 filled with the ink 290. In this case, since the heater 240 that opposes the nozzle 260 is concavely hemispherical, expansion energy of the bubble 280 is not scattered but concentrated toward the nozzle 260, thereby decreasing unnecessary energy consumption while accelerating the pressure rise in the ink chamber 230.

Figure 11D:
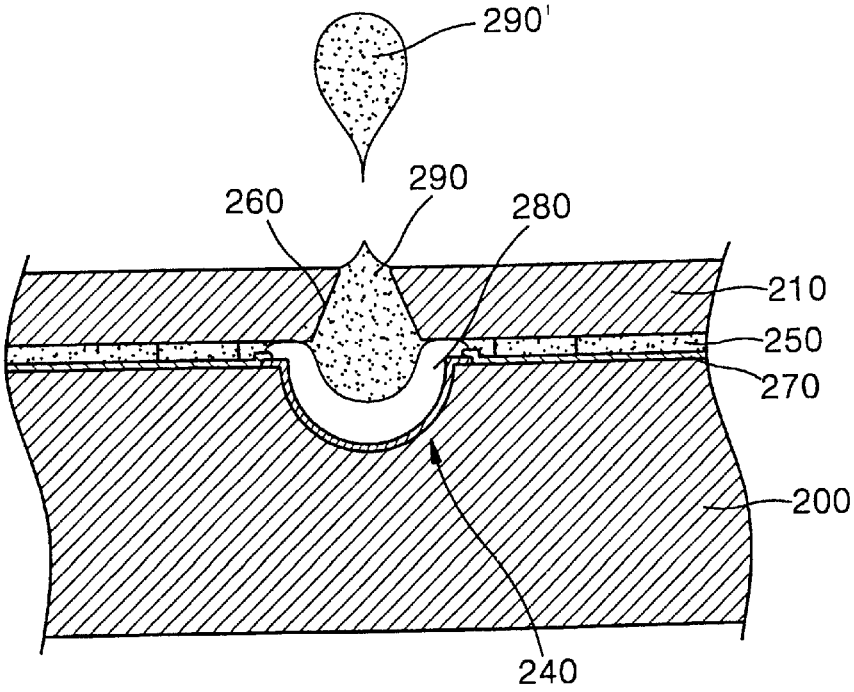

When the bubble 280 continues to expand so that the pressure in the ink chamber 230 exceeds a predetermined level, as shown in FIG. 11D, an ink droplet 290' is ejected through the nozzle 260 and then the bubble 280 starts to shrink. If the bubble 280 contracts so that the barrier formed between the ink chamber 230 and the ink feed channel 250 disappears, the ink 290 refills the ink chamber 230 through the ink feed channel 250. In this case, as described above, since the ink feed channel 250 connects with the entire circumference of the ink chamber 230, the refill speed increases.

A bubble-jet type ink-jet printing head according to the present invention as described above has several advantages. First, since a heater is concavely hemispherical opposing a nozzle, the surface area for heat generation is wide. This results in a high bubble development rate due to a large initial bubble generation amount and a high pressure rise rate in an ink chamber. Furthermore, the expansion energy of the bubble is not dispersed but concentrated toward the nozzle, thereby reducing unnecessary energy consumption while accelerating the pressure rise in the ink chamber. Accordingly, an energy efficiency is improved and an ejection driving frequency becomes higher. Second, an ink feed channel connects with the entire circumference of the ink chamber, thereby promptly refilling the ink into the ink chamber after ejection of an ink droplet and furthermore increasing the print speed. Third, since a barrier is formed between the ink chamber and the ink feed channel by the bubble formed on a flange of the heater to prevent a back flow of ink, thus preventing the dispersion of ink ejection energy and the occurrences of interference between adjacent nozzles.

Although the present invention has been described with reference to particular embodiments, the illustrated embodiments are only examples, and it should be understood by those skilled in the art that various changes in form and details may be made therein without departing from the spirit and scope of the present invention as defined by the appended claims.

What is claimed is:

1. A bubble-jet type ink jet printing head, comprising:

a nozzle plate perforated by a plurality of nozzles through which ink is ejected;

a substrate supporting the nozzle plate, on which a plurality of heaters having three-dimensionally concave surfaces oppose the plurality of nozzles, respectively;

a plurality of electrodes disposed on the top surface of the substrate and electrically coupled to each heater so as to apply current to each heater;

a plurality of ink chambers disposed between a bottom of the nozzle plate and the surfaces of the corresponding heaters and filled with ink; and an ink feed channel, formed between the nozzle plate and the substrate so as to connect with the plurality of ink chambers, for supplying ink to the plurality of ink chambers.

2. The printing head of claim 1, wherein heat generated per unit area is substantially uniform over the entire concave surface of each one of said plurality of heaters.

3. The printing head of claim 2, wherein each heater is substantially hemispherical.

4. The printing head of claim 2, wherein each heater includes a hemispherical member and a flange disposed along a rim of the hemispherical member.

5. The printing head of claim 4, wherein said flange has a higher resistance than the hemispherical member.

6. The printing head of claim 1, wherein the ink feed channel joins each ink chamber throughout each point on an entire circumference of a rim of each one of said plurality of heaters.

7. The printing head of claim 6, wherein the ink feed channel comprises a first passage formed along the circumference of each ink chamber in the form of an annular channels exterior to said heaters, and second passages which extend from each first passage in the form of radial channels.

8. The printing head of claim 6, wherein the ink feed channel is formed on the bottom surface of the nozzle plate to a predetermined depth.

9. The printing head of claim 8, wherein the ink feed channel is formed by means of excimer laser machining.

10. The printing head of claim 6, wherein the ink feed channel is formed on the top surface of the substrate to a predetermined depth.

11. The printing head of claim 10, wherein the ink feed channel is formed by means of etching and thin film formation processes.

12. A bubble-jet type ink jet printing head, comprising:

a substrate having a top surface comprising a plurality of cavities, each one of said plurality of cavities being hemispherical in shape and each one of said plurality of cavities being evenly spaced from one another;

a plurality of heating elements, each one of said plurality of heating elements being essentially hemispherical in shape and being disposed within respective ones of said plurality of cavities in said substrate;

a nozzle plate being disposed on top of said substrate, said nozzle plate being perforated by a plurality of nozzle holes, each one of said plurality of nozzle holes being located directly above a center of respective ones of said plurality of cavities; and a plurality of spacers disposed between said nozzle plate and said top surface of said substrate, each one of said plurality of spacers being located between ones of said plurality of cavities.

13. The printing head of claim 12, wherein each heating element is electrically connected to a pair of electrodes.

14. The printing head of claim 12, wherein a plurality of ink feed channels are present in spaces between said nozzle plate and said top surface of said substrate, said plurality of ink feed channels are located between a pair of spacers and between ones of said plurality of spacers and ones of said plurality of heating elements, wherein said plurality of ink feed channels supply ink to each one of said plurality of heating elements for corresponding ones of said plurality of cavities.

15. The printing head of claim 14, wherein said plurality of ink feed channels comprise:

a plurality of annular channels, disposed exterior to each of said plurality of said heating elements and located between said heating elements and said spacers; and a plurality of channels extending radially from each of said plurality of cavities, each of said radial channels connecting to ones of said plurality of annular channels, each one said plurality of channels extending radially from said cavities being disposed between a pair of spacers.

16. The printing head of claim 12, wherein each heater element further comprises a flange extending around said hemisphere, said flange being formed integrally with said heating element, said flange being adjacent to said top surface of said substrate around said cavity for each one of said plurality of heaters and each one of said plurality of cavities.

17. The printing head of claim 16, wherein each flange has a resistance per unit radial distance that is higher than a resistance per unit radial distance of said hemispherical portion of said heating element.

18. The printing head of claim 17, wherein said spacers are formed integrally with a bottom surface of said nozzle plate.

19. The printing head of claim 17, wherein said spacers are formed integrally with said top surface of said substrate.

20. The printing head of claim 12, wherein said spacers are formed integrally with a bottom surface of said nozzle plate.

21. The printing head of claim 12, wherein said spacers are formed integrally with said top surface of said substrate.

* * * * *